US007316456B2

(12) United States Patent
Walker et al.

(10) Patent No.: US 7,316,456 B2
(45) Date of Patent: Jan. 8, 2008

(54) ROADHEADING OR MINING MACHINE WITH ROOF BOLT DRILLING AND SETTING DEVICES

(75) Inventors: Ralf Walker, Duisburg (DE); Franz Wels, Zeltweg (AT); Karl Lerchbaum, Zeltweg (AT); Manfred Meier, Fohnsdorf (AT)

(73) Assignee: Voest-Alpine Bergtechnik Gesellschaft m.b.H., Zeltweg (AT)

( * ) Notice: Subject to any disclaimer, the term of this patent is extended or adjusted under 35 U.S.C. 154(b) by 0 days.

(21) Appl. No.: 11/008,365

(22) Filed: Dec. 9, 2004

(65) Prior Publication Data

US 2005/0129466 A1 Jun. 16, 2005

(30) Foreign Application Priority Data

Dec. 16, 2003 (AT) ..... GM897/2003

(51) Int. Cl.
*E21D 20/00* (2006.01)

(52) U.S. Cl. ..... 299/33

(58) Field of Classification Search ..... 299/11, 299/33; 405/259.1, 303, 288, 291, 302.1
See application file for complete search history.

(56) References Cited

U.S. PATENT DOCUMENTS 4,865,390 A * 9/1989 Shrader et al. ..... 299/11

FOREIGN PATENT DOCUMENTS

| | | | |
|---|---|---|---|
| AT | 407 553 B | | 4/2001 |
| DE | 31 08 877 A1 | | 1/1982 |
| DE | 19956715 | * | 6/2000 |
| WO | WO 92/05339 | * | 4/1992 |

* cited by examiner

*Primary Examiner*—Sunil Singh
(74) *Attorney, Agent, or Firm*—Chapman and Cutler LLP

(57) ABSTRACT

In a roadheading or mining machine including cutting tools movable over the mine face and roof bolt drilling and setting devices, at least two roof bolt drilling and setting devices are pivotally connected with the machine laterally outside the longitudinal central plane of the machine. The roof bolt drilling and setting devices are pivotally supported on a bolting platform capable of being displaced in the longitudinal direction of the machine, or on an element connected with the bolting platform.

12 Claims, 8 Drawing Sheets

ROADHEADING OR MINING MACHINE WITH ROOF BOLT DRILLING AND SETTING DEVICES

BACKGROUND OF THE INVENTION

1. Field of the Invention

The invention relates to a roadheading or mining machine including cutting tools movable over the mine face and roof bolt drilling and setting devices, wherein at least two roof bolt drilling and setting devices are pivotally connected with the machine laterally outside the longitudinal central plane of the machine.

2. Prior Art

A roadheading or mining machine of this type is, for instance, known from AT 408 016 B. In that roadheading machine, the individual roof bolt drilling and setting devices are arranged on the stationary machine frame so as to allow roof bolting in planes extending transversely to the driving direction by appropriately pivoting the roof bolt drilling and setting devices in order to enable the support of the roof and lateral wall. In addition, that machine permits what is called advanced bolting, by which the roof bolt drilling and setting devices are pivoted into a position in which roof bolting is feasible as far as to near the mine face or even into the mine face. The roof bolt drilling and setting devices in that case are arranged laterally outside the longitudinal central plane of the roadheader so as to enable those roof bolt drilling and setting devices to be mounted in a manner pivotable over a large angular range without colliding with one another or with other devices such as, for instance, exhausters or supporting means, which are usually provided close to the roof in the longitudinal central plane of the roadheader.

Also from AT 410 002 B, a cutting machine has become known, in which the roof bolt drilling and setting devices are arranged on the machine frame. From AT 5578 U1, a roadheading or mining machine has become known, whose roof bolt drilling and setting device is arranged substantially in the longitudinal center of the frame and pivotally mounted on a rollover, whose pivot axis crosses the vertical axis of the pivot mechanism, the pivot angle of the roof bolt drilling and setting device being larger than 180°. AT 407 553 B discloses a roof bolt drilling and setting device which is connected, in a manner pivotable about an axis extending transversely to the longitudinal direction of the machine, with at least one tie rod extending in the longitudinal direction of the machine, said tie rod being connected with a supporting means capable of being braced between the roof and the floor near the mine face.

Furthermore, a roof bolt drilling and setting device which is supported on a telescopic pivot arm has become known from DE 196 41 922 C1.

SUMMARY OF THE INVENTION

The invention aims to provide a roadheading or mining machine of the initially defined kind, in which the roof bolt drilling and setting devices are arranged in a manner so as to not collide with other parts of the roadheading or mining machine and, in particular, a cutter arm that is pivotable in the height direction. At the same time, the range of manipulation of the roof bolt drilling and setting device is not to be restricted and several bolts are to be insertable in a bolt row independently of each other. In doing so, the roof bolt drilling and setting devices are to be pivotable over a wide pivotal range in order to secure the roof and lateral wall, wherein bolting near the mine face and, if required, advanced bolting into the mine face are to be rendered feasible, in particular. At the same time, a low structural height of the roadheading or mining machine is to be guaranteed too.

To solve this object, the invention, departing from the initially described roadheading or mining machine, is essentially characterized in that the roof bolt drilling and setting devices are pivotally supported on a bolting platform capable of being displaced in the longitudinal direction of the machine, or on an element connected with said bolting platform. By the roof bolt drilling and setting devices being arranged to be displaceable in the longitudinal direction, it has become feasible to move the roof bolt drilling and setting devices for the setting of bolts into a position located close to the mine face, while reaching a safe support of the roof bolt drilling and setting devices by the bolting platform. After bolting, the roof bolt drilling and setting devices can again be retracted together with the bolting platform to such an extent that a collision with the cutter arm will be prevented. The bolting platform, at the same time, offers the opportunity to provide an operating console including control boards for the operation of the roof bolt drilling and setting devices. In order to ensure the safe support of the bolting platform in the position advanced towards the mine face, the configuration is preferably further developed such that the bolting platform, at least in its front portion, cooperates with a slide bearing provided on the cutter arm of the roadheading or mining machine. The bolting platform, in its front portion, is thereby supported on the cutter arm, to which end the cutter arm is moved into a downwardly pivoted position. The displacement of the bolting platform in the direction towards the mine face causes the bolting platform to come to lie on the slide bearing by its front portion such that a stable position of the bolting platform will be safeguarded even in a position displaced closely to the mine face. The cutting operation is naturally interrupted in this position in order to allow the setting of bolts. After this, the bolting platform, together with the roof bolt drilling and setting devices, is again displaced rearwards into a parking position in which a collision with other parts of the roadheading or mining machine will be excluded.

In order to minimize, in the parking position of the roof bolt drilling and setting devices, the space required for the arrangement of the roof bolt drilling and setting devices, and to reach, in particular, a reduced structural height of the roadheading or mining machine in the retracted position of the roof bolt drilling and setting devices, the configuration in an advantageous manner is further developed such that the roof bolt drilling and setting devices are supported on a pivot arm connected with the bolting platform so as to be pivotable about a substantially horizontal axis. The roof bolt drilling and setting devices may consequently be pivoted together with the pivot arm from an operating position into a resting position. In the operating position, the roof bolt drilling and setting devices are basically oriented in a substantially vertical direction, whereby the roof bolt drilling and setting devices, departing form the vertical starting position, are suitably oriented by separate pivot drives in order to obtain the respectively desired bolting pattern. As the roof bolt drilling and setting devices are being displaced back into the parking position, the roof bolt drilling and setting devices are pivoted into a substantially horizontal position by the aid of the pivot arm so as to ensure a substantially reduced space demand.

As already mentioned above, the roof bolt drilling and setting devices are pivotally mounted in order to enable the selective introduction of bolts in the respectively desired positions on the roof and lateral wall as well as, optionally, mine face. To this end, the configuration is preferably further developed such that the roof bolt drilling and setting devices are each arranged to be pivotable about a first axis extending transversely to the longitudinal plane of the machine and a second axis extending transversely to the first axis. In this respect, the pivot axes may be arranged in a manner that the first axis allows for pivotal movement of the roof bolt drilling and setting devices towards the mine face and away from the same, and the second pivot axis allows for pivotal movement of the roof bolt drilling and setting devices in the peripheral direction of the cross section exposed by the machine.

A particularly compact arrangement of the pivot drives and pivot axes will be feasible, if the pivot drive for pivoting the roof bolt drilling and setting devices about the second axis is arranged at a larger distance from the substantially horizontal pivot axis of the pivot arm than the distance of the roof bolt drilling and setting devices from the substantially horizontal pivot axis of the pivot arm, as in correspondence with a preferred embodiment of the invention. Such a configuration enables the space-saving arrangement of the roof bolt drilling and setting devices, whereby, due to the fact that the roof bolt drilling and setting devices are arranged more closely to the substantially horizontal pivot axis of the pivot arm intended to pivot the roof bolt drilling and setting devices from an operating position into a parking or resting position than the pivot drive intended to pivot the roof bolt drilling and setting devices in the peripheral direction, the roof bolt drilling and setting devices in the horizontal position of rest will come to lie closer to the bolting platform so as to enable special space saving. Moreover, this configuration will offer advantages if hydraulic cylinders are used for the pivot drive, since these can be arranged by exploiting particularly favorable leverages.

In a preferred manner, the configuration in this respect is devised such that a carrying structure for the roof bolt drilling and setting devices is provided, which comprises a carrier articulately connected with the pivot arm so as to be pivotable about the first axis and a mounting bracket arranged in parallel with said carrier. The mounting bracket is arranged to be pivotable relative to the carrier articulately connected with the pivot arm, wherein the configuration in a preferred manner is devised such that the mounting bracket comprises an L-shaped projection which is articulately connected with the carrier so as to be pivotable about the second axis. On account of the collision-free arrangement of the roof bolt drilling and setting devices on a bolting platform moved forward, a particularly large pivot range of the roof bolt drilling and setting devices is rendered feasible, and the configuration is preferably devised such that the roof bolt drilling and setting devices are pivotable about the second axis over a pivot range of between 90° and 180°, preferably at least 120°.

As already mentioned, an operating console including control boards may be arranged on the bolting platform, whereby the bolting platform, in addition, renders feasible the arrangement of a fold-down working platform which permits the operating personnel to get into the immediate vicinity of the roof bolt drilling and setting devices in order to suitably operate the roof bolt drilling and setting devices or carry out maintenance work. The configuration in this case is preferably devised such that at least one working platform capable of being folded down from the bolting platform and positioned in the vicinity of the roof bolt drilling and setting devices is provided.

In order to reach an additional protection of the roof, mats are usually installed in the roof region to be secured, which mats are fixed by the subsequently inserted rock bolts. In order to ensure as rapid and efficient an installation of such mats as possible, the configuration is preferably devised such that a supporting device is articulately connected with the bolting platform for the pressing of said mats against the roof. By articulately connecting a suitable supporting device with the bolting platform, it has become feasible to pivot the supporting device from a horizontal resting position into a substantially vertical operating position in a manner similar to the roof bolt drilling and setting device, so that the space required by the supporting device and, in particular, the space required in the height direction of the machine will be kept as small as possible in the position of rest. By the supporting device being connected with the bolting platform in the same manner as the roof bolt drilling and setting device, it is feasible to move both devices together into the respectively desired position and use them together subsequently. In a preferred manner, the supporting device is designed to be telescopically extractable in the longitudinal direction so as to enable the mat placed on the supporting device to be lifted and pressed against the roof.

BRIEF DESCRIPTION OF THE DRAWINGS

In the following, the invention will be explained in more detail by way of an exemplary embodiment schematically illustrated in the drawing. Therein:

FIG. 3 is a view analogous to FIG. 2 with the roof bolt drilling and setting devices folded in;

DETAILED DESCRIPTION OF A PREFERRED EMBODIMENT OF THE INVENTION

Figure 1:
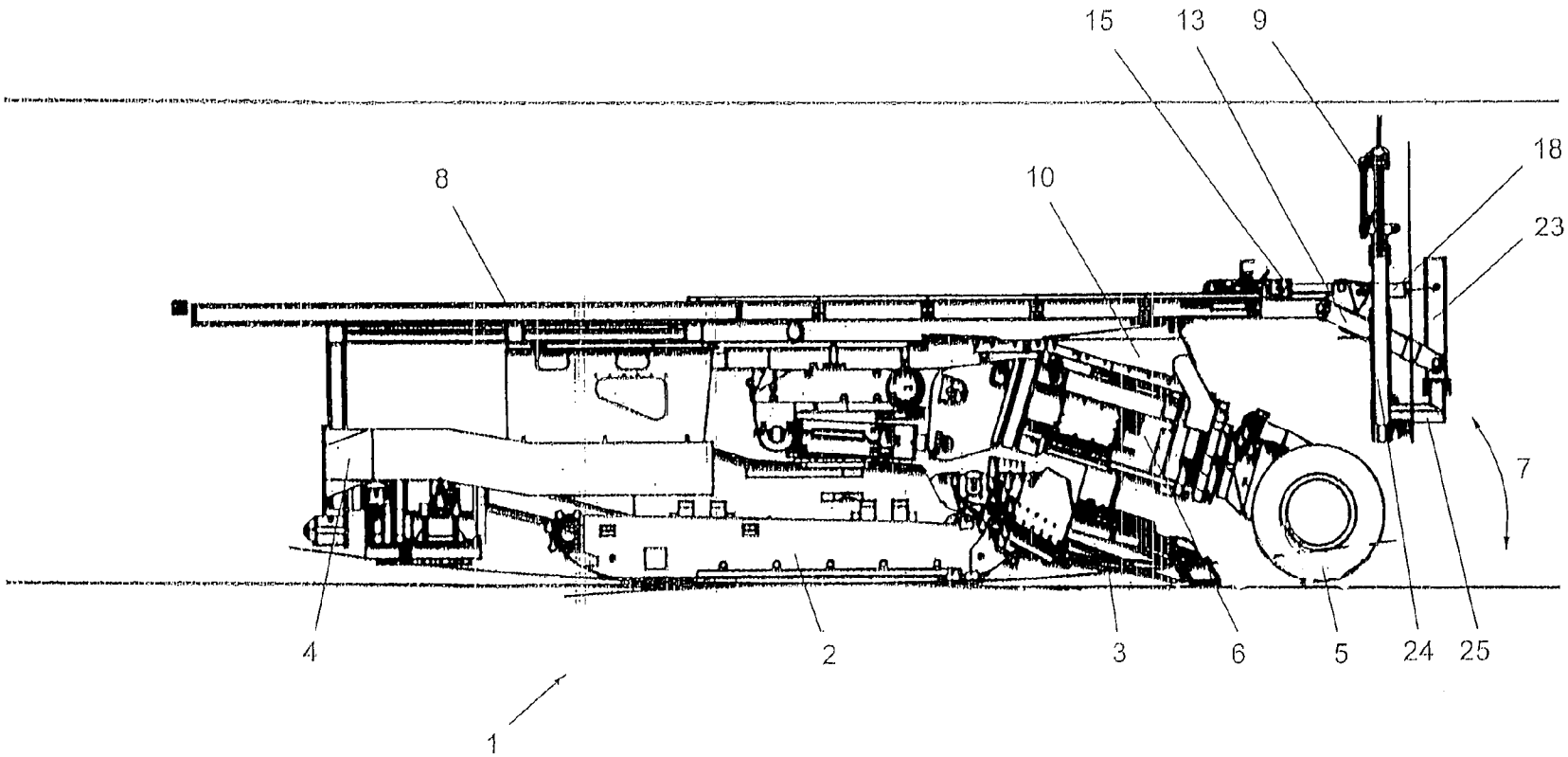
FIG. 1 is a side view of a roadheading machine.

FIG. 1 depicts a roadheading machine 1 whose crawler mechanism is denoted by 2. To the machine frame are fixed a loading means 3 near the front end and a haulage means 4 projecting beyond the rear end. The cutting tools 5, which are rotationally mounted on the cantilever arm 6, are pivotable in the height direction according to double arrow 7. The bearing of the cantilever arm 6 may be provided on a carriage that is displaceable relative to the base frame of the machine in the longitudinal direction of the machine. Furthermore, a bolting platform 8 is provided, on whose front end the roof bolt drilling and setting devices 9 are supported. The bolting platform 8 in the position illustrated in FIG. 1 is supported on a slide bearing 10 provided on the cantilever arm 6.

Figure 2:
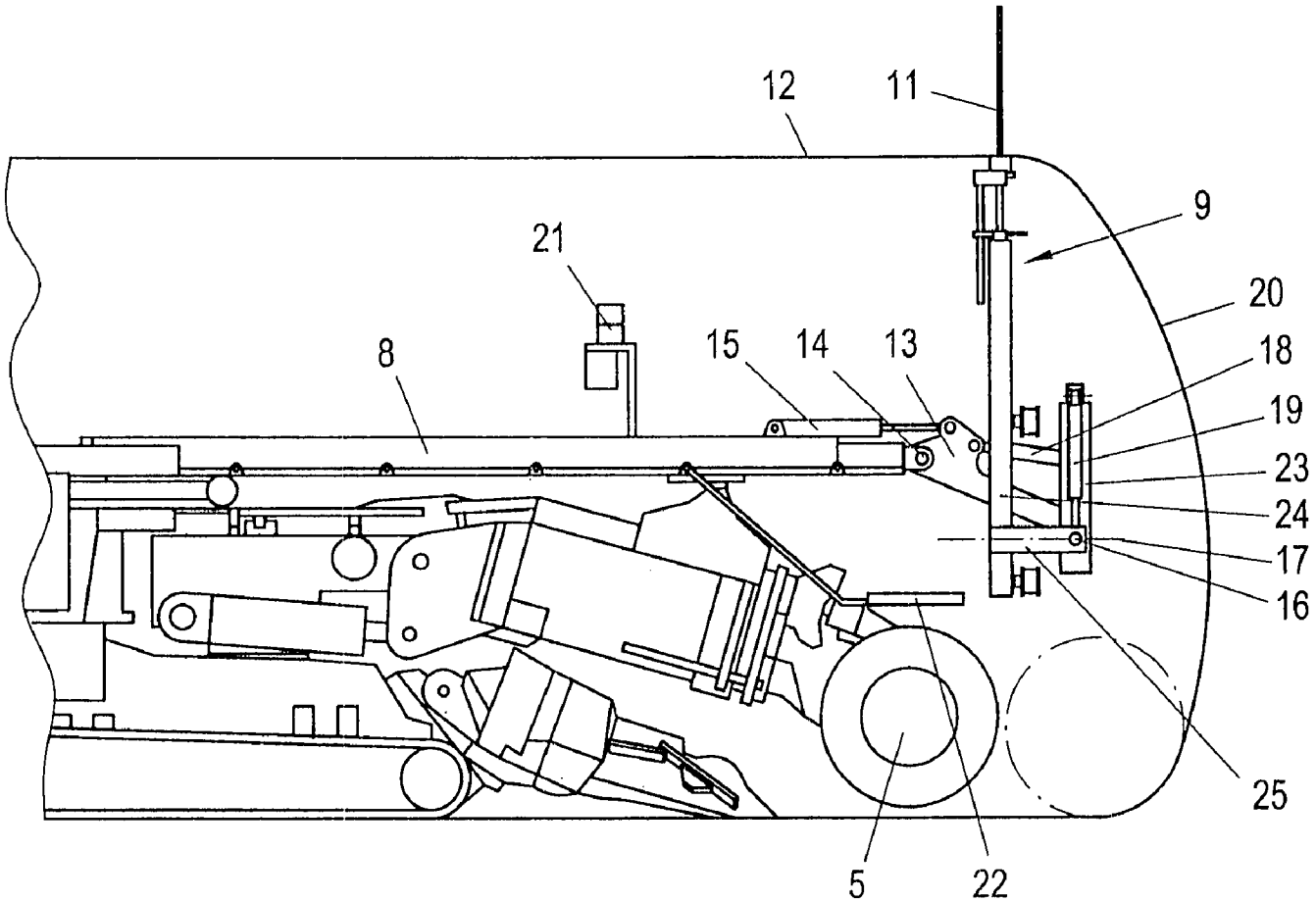
FIG. 2 is an enlarged illustrated of the front portion of the roadheading machine including roof bolt drilling and setting devices.
Figure 3:
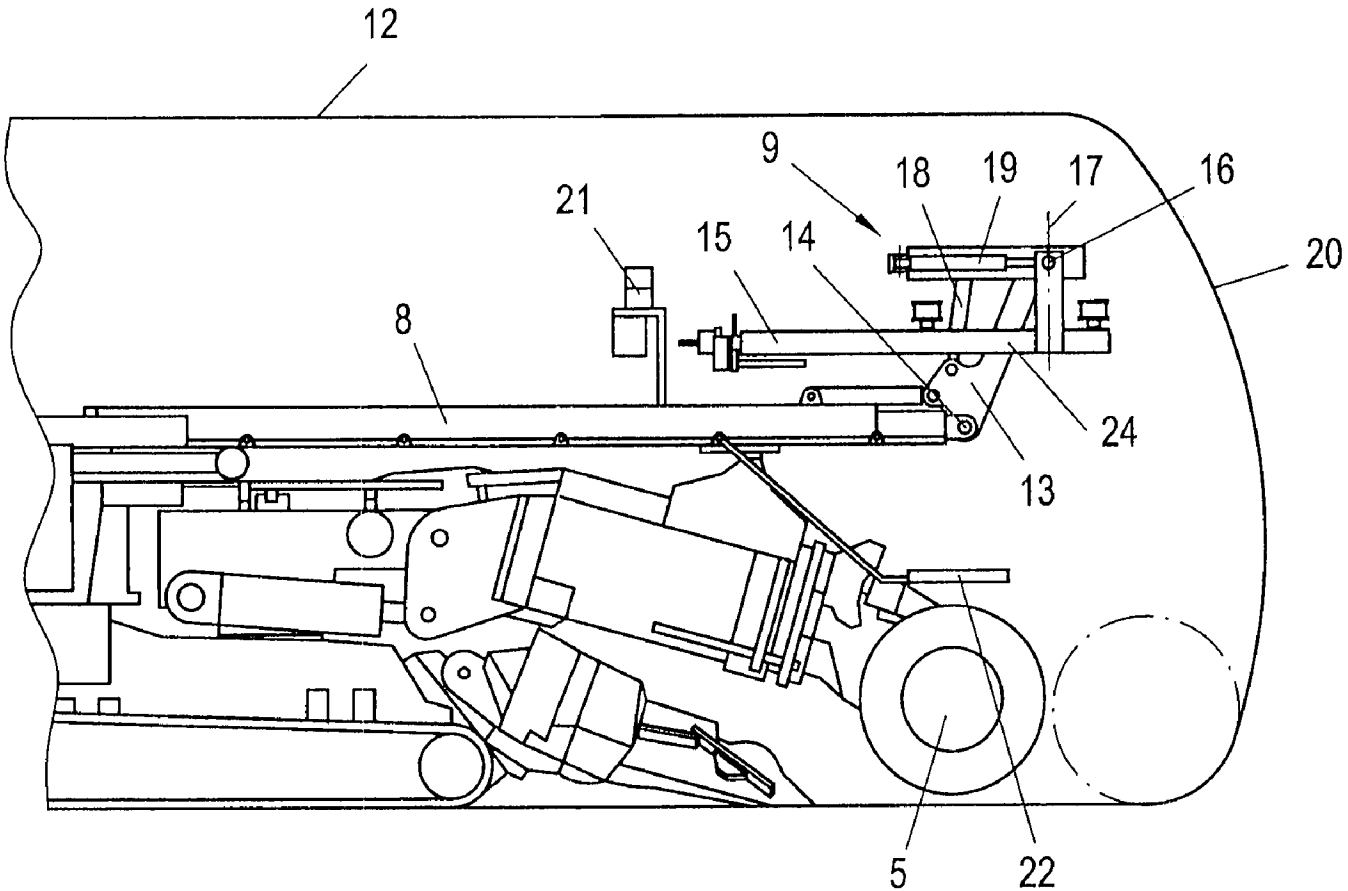
Figure 4:
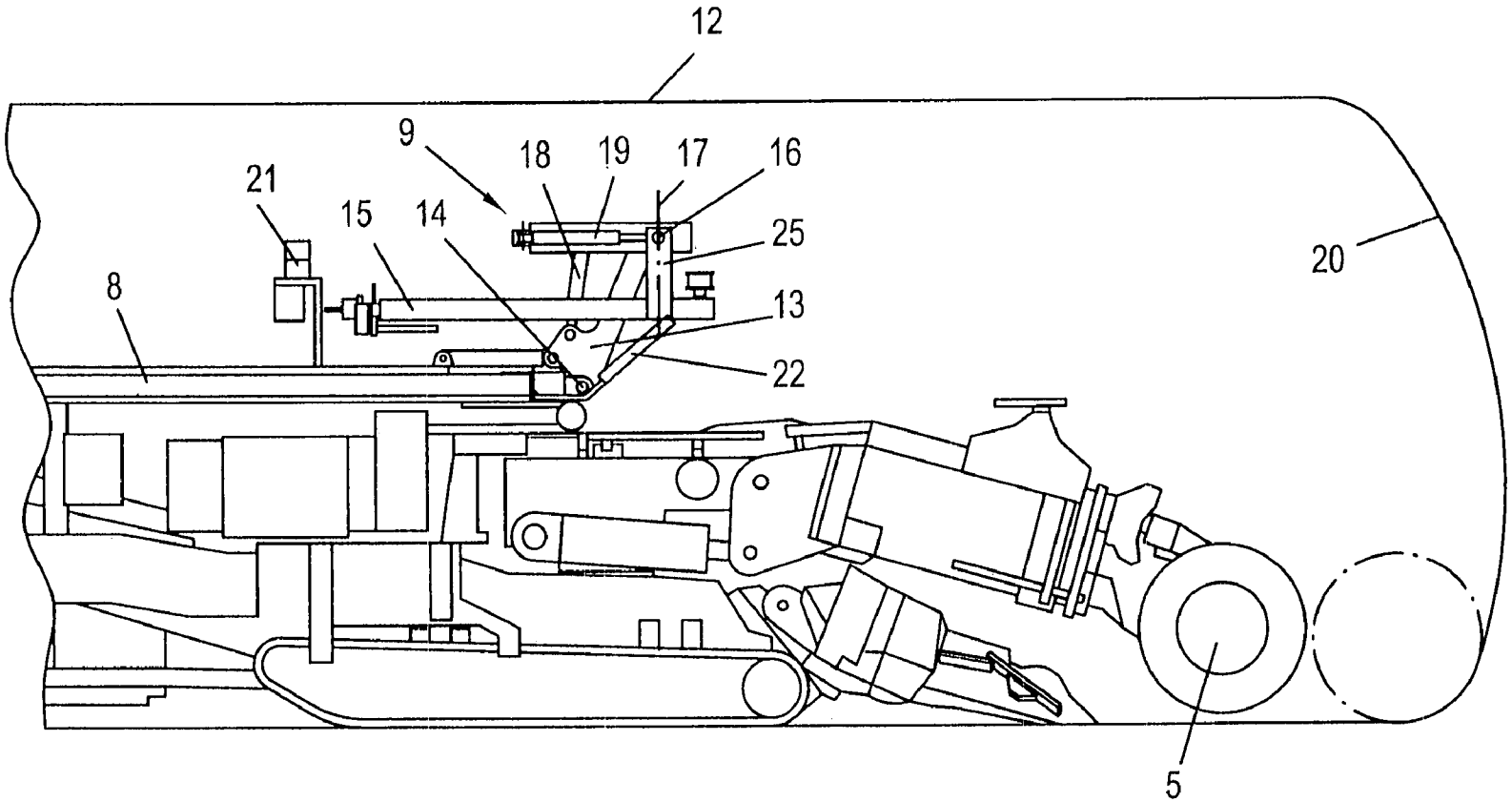
FIG. 4 is an illustration analogous to FIG. 3 with the roof bolt drilling and setting devices retracted.

In the enlarged illustration according to FIG. 2, the roof bolt drilling and setting devices 9 are depicted in a position in which bolts 11 are being inserted into the roof 12. In doing so, the roof bolt drilling and setting devices 9 are supported on a pivot arm 13 arranged to be pivotable about a substantially horizontal axis 14 relative to the bolting platform 8. The cylinder piston unit that serves to pivot the pivot arm 13 is denoted by 15. The roof bolt drilling and setting devices 9 are mounted so as to be pivotable relative to the pivot arm 13 both about a first axis 16 extending transversely to the longitudinal plane of the machine and about a second axis 17 extending transversely to the first axis 16. The pivot drive used to pivot the roof bolt drilling and setting devices 9 about the first axis 16 is comprised of a cylinder piston unit 18, the pivot drive used to pivot the roof bolt drilling and setting devices 9 about the axis 17 is comprised of a cylinder piston unit 19. It is apparent that the pivot drive 19 for pivoting the roof bolt drilling and setting devices 9 about the second axis 17 is arranged at a larger distance from the pivot axis 14 of the pivot arm 13 than the distance of the roof bolt drilling and setting devices 9 from this pivot axis 14. This causes the roof bolt drilling and setting devices 9 to assume the resting position near the bolting platform 8 illustrated in FIG. 3, after a pivotal movement of the pivot arm 13 along with the roof bolt drilling and setting devices 9 from an operating position, so as to take into account the space conditions limited in the height direction and avoiding a collision of the roof bolt drilling and setting devices with road installations. The bolting platform 8 in this case may be moved back as far as to the position shown in FIG. 4 such that, in the main, a position will be reached, in which the cutting tools 5 can brush over the entire mine face 20 unhampered.

Control boards 21 for operating the roof bolt drilling and setting devices are provided on the bolting platform 8. Furthermore, working platforms 22 capable of being folded up or down from the bolting platform 8 are provided, which, in the fold-down position, are in the immediate vicinity of the roof bolt drilling and setting devices so as to enable operators to have immediate access to the operation of the roof bolt drilling and setting devices 9.

Figure 6:
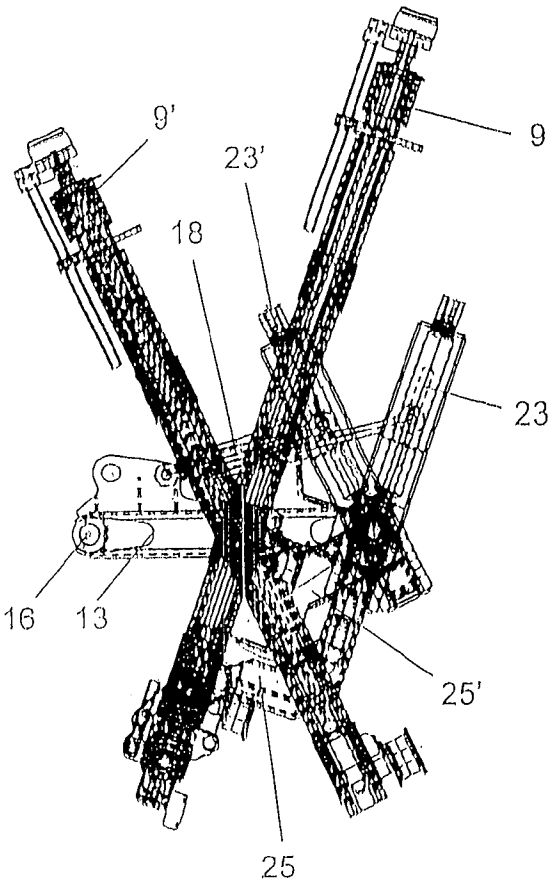
FIG. 6 is a side view of the roof bolt drilling and setting devices.
Figure 5:
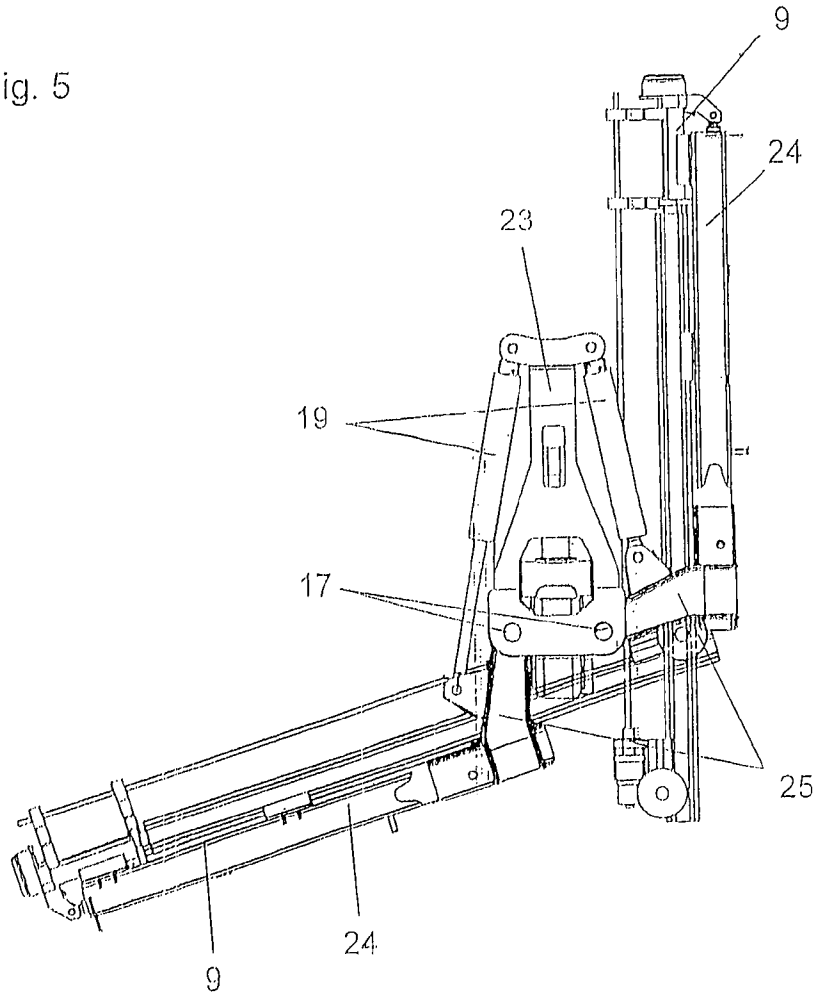
FIG. 5 is a front view of the roof bolt drilling and setting devices.

The supporting structure for the roof bolt drilling and setting devices 9 is comprised of a carrier 23 arranged to be pivotable relative to the pivot arm 13 about this axis 16 as well as a mounting bracket 24 arranged in parallel with the carrier 23. The mounting bracket 24 comprises L-shaped projections 25 mounted to be pivotable relative to the carrier 23 about the axis 17. FIGS. 5 and 6 illustrate the supporting structure and pivot drives for the roof bolt drilling and setting devices 9 in more detail. From the front view according to FIG. 5, it is apparent that one roof bolt drilling and setting device is each arranged on either side of the longitudinal central plane of the machine. The roof bolt drilling and setting device 9 illustrated on the right-hand side of FIG. 5 is shown in the vertical position, whereas the left-hand roof bolt drilling and setting device is shown in a position pivoted downwards about axis 17 by about 120°. In the side view according to FIG. 6, the pivotability of the roof bolt drilling and setting devices 9 about the axis 16 is illustrated, the roof bolt drilling and setting devices in the forwardly pivoted position being denoted by 9 and in the rearwardly pivoted position being denoted by 9'.

Figure 7:
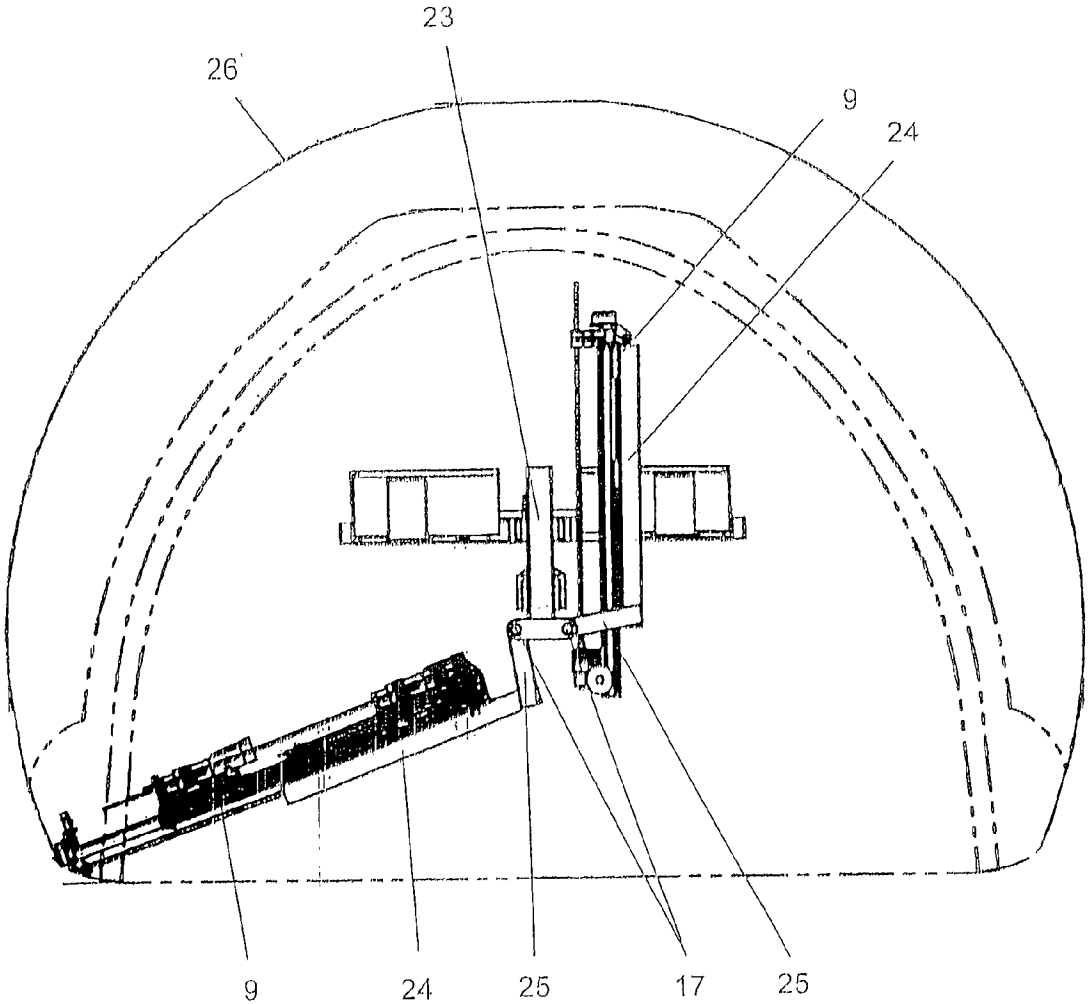
FIG. 7 is another front view of the roof bolt drilling and setting devices.

In FIG. 7, the roof bolt drilling and setting device is finally illustrated in another front view, from which it is apparent that the large pivotal range of the roof bolt drilling and setting devices 9 allows bolts to be set at any desired points of the lateral wall and roof surface within the road cross section 26.

Figure 8:
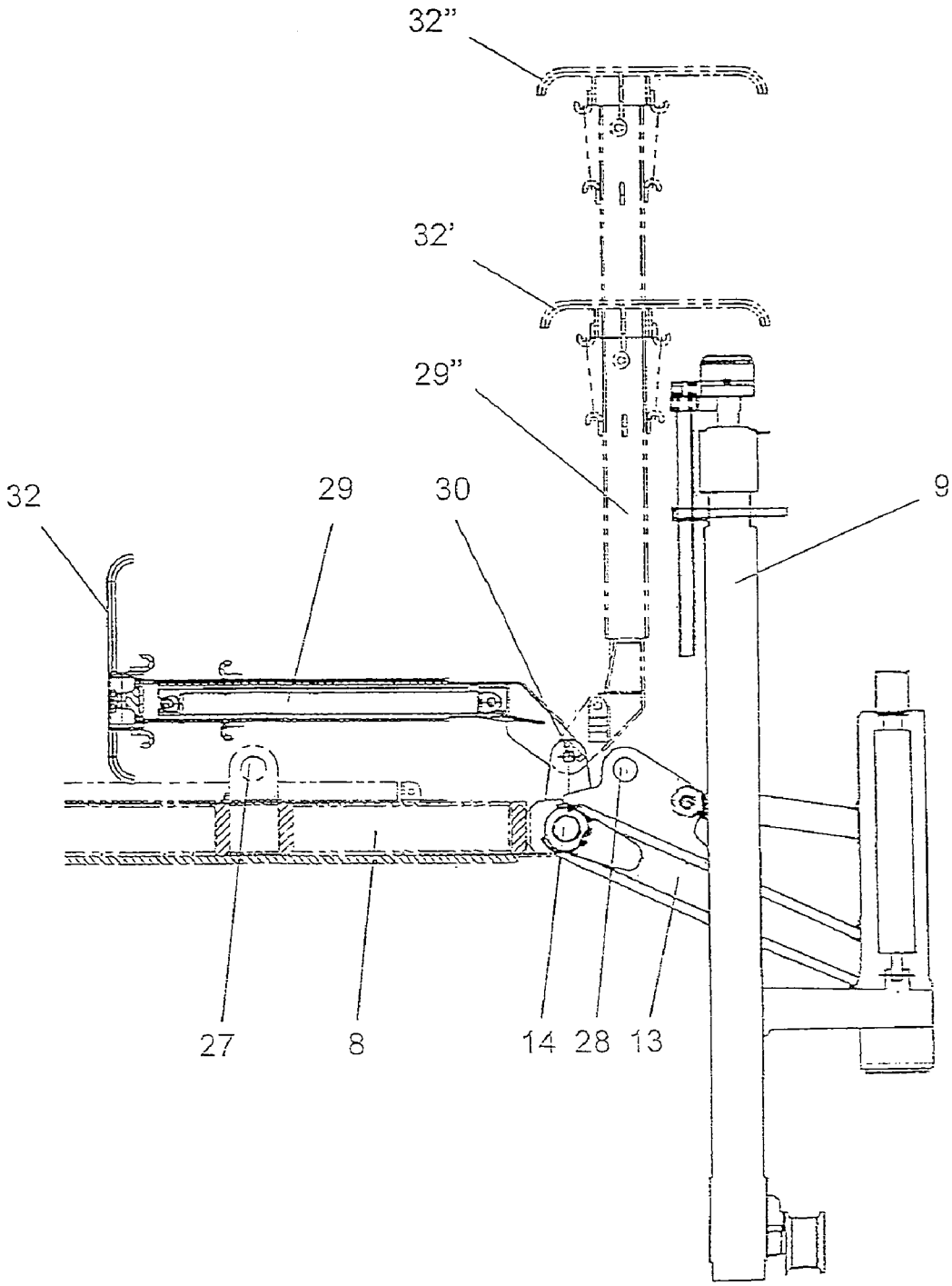
FIG. 8 is a detailed view of the front portion of the bolting platform in a modified configuration.

FIG. 8 is a detailed view of the front portion of the bolting platform 8, to which the pivot arm 13 for the roof bolt drilling and setting device 9 is coupled in a manner pivotable about an axis 14. Bearing eyes 27 and 28 are visible, to which the cylinder piston unit 15 for pivoting the pivot arm 13 is coupled, which has been omitted from FIG. 8 for the sake of clarity. In the configuration according to FIG. 8, a supporting means 29 is additionally provided on the front end of the bolting platform 8, which supporting means is supported on the front end of the bolting platform 8 in a manner pivotable about an axis 30. The supporting means 29 is pivotable from a horizontal resting position 29 into a vertical operating position 29' by the aid of a cylinder piston unit 31 depicted in FIG. 9. The supporting means 29 on its upper end comprises carrying arms 32 adapted to receive a mat, which is subsequently pressed against the roof by movement into a position 32". After this, the two roof bolt drilling and setting devices 9 are each set at the roof laterally outside the carrying arms 32, whereby the mat is fixed by the insertion of the bolts.

Figure 9:
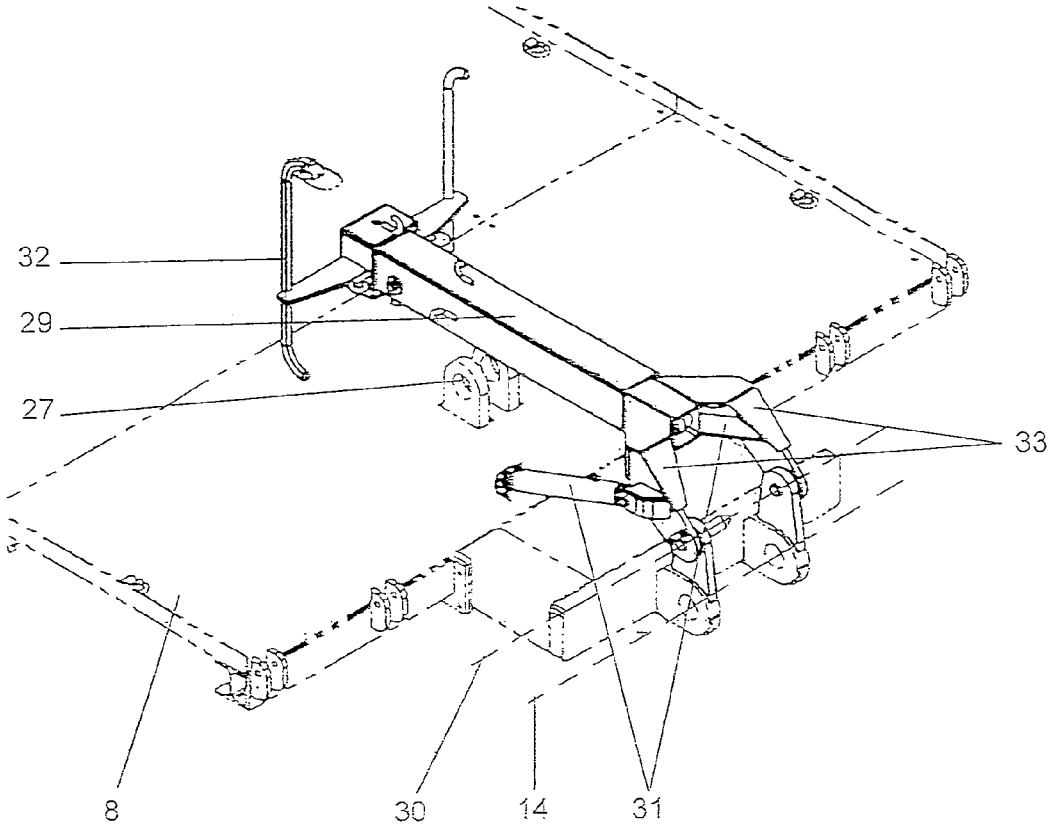
FIG. 9 is a perspective view of the configuration according to FIG. 8.

From the perspective view according to FIG. 9, which does not show the roof bolt drilling and setting device 9 for the sake of clarity, it is apparent that the supporting means 29, on its end facing the pivot axis 30, is provided with two laterally cantilevering arms 33 which, between them, define a clearance for the passage of the cylinder piston unit 15.

What we claim is:

1. A roadheading or mining machine comprising cutting tools movable over a mine face, a cutting arm, a plurality of roof bolt drilling and setting means, wherein at least two of said roof bolt drilling and setting means are pivotally connected with the roadheading or mining machine laterally outside a longitudinal central plane of said machine, and a bolting platform supported on said machine behind said cutting arm, said bolting platform being capable of being displaced in a longitudinal direction of said machine, being constructed to cooperate at least in its front position with a slide bearing provided on said cutting arm, and being constructed to pivotaily support said roof bolt drilling and setting means.

2. A roadheading or mining machine as set forth in claim 1, wherein said bolting platform comprises an element connected therewith and constructed to pivotally support said roof bolt drilling and setting means.

3. A roadheading or mining machine as set forth in claim 1, further comprising a substantially horizontal pivot axis and a pivot arm pivotally connected with said bolting platform so as to be pivotable about said substantially horizontal pivot axis and constructed to support said roof bolt drilling and setting means.

4. A roadheading or mining machine as set forth in claim 3, having a first axis extending transversely to the longitudinal plane of said machine and a second axis extending transversely to said first axis, and wherein each of said roof bolt drilling and setting means is arranged to be pivotable about said first axis and said second axis.

5. A roadheading or mining machine as set forth in claim 4, further comprising a pivot drive constructed to pivot said roof bolt drilling and setting means about said second axis, said pivot drive being arranged at a larger distance from said substantially horizontal pivot axis of said pivot arm than a distance of said roof bolt drilling and setting means from said substantially horizontal pivot axis of said pivot arm.

6. A roadheading or mining machine as set forth in claim 5, further comprising a carrying structure for said roof bolt drilling and setting means, and wherein said carrying structure is comprised of a carrier articulately connected with said pivot arm so as to be pivotable about said first axis and a mounting bracket arranged in parallel with said carrier.

7. A roadheading or mining machine as set forth in claim 6, wherein said mounting bracket comprises L-shaped projection means articulately connected with said carrier so as to be pivotable about said second axis.

8. A roadheading or mining machine as set forth in claim 4, wherein said roof bolt drilling and setting means is pivotable about said second axis over a pivot range of between 90° and 180°.

9. A roadheading or mining machine as set forth in claim 8, wherein said roof bolt drilling and setting means is pivotable about said second axis over a pivot range of at least 120°.

10. A roadheading or mining machine as set forth in claim 1, further comprising at least one operating platform capable of being folded down from said bolting platform and brought into a position close to the mine face.

11. A roadheading or mining machine as set forth in claim 1, further comprising a supporting means articulately connected with said bolting platform and constructed to receive mats to be pressed at said roof by said supporting means.

12. A roadheading or mining machine as set forth in claim 11, wherein said supporting means is designed to be telescopically extractable in its longitudinal direction.

* * * * *